United States Patent [19]

Schurman

[11] Patent Number: 5,002,185

[45] Date of Patent: Mar. 26, 1991

[54] HINGED COVER FOR A GOLF BAG CONTAINER

[75] Inventor: Peter T. Schurman, Woodbridge, Conn.

[73] Assignee: The Plastic Forming Company, Inc., Woodbridge, Conn.

[21] Appl. No.: 490,718

[22] Filed: Mar. 8, 1990

[51] Int. Cl.[5] ..... A63B 55/00; B65D 43/00

[52] U.S. Cl. ..... 206/315.4; 206/315.3; 220/338

[58] Field of Search ..... 206/315.3, 315.4; 150/159; 190/110, 111, 112; 220/335, 337, 338; 215/235, 228

[56] References Cited

U.S. PATENT DOCUMENTS

| | | | |
|---|---|---|---|
| 1,647,551 | 11/1927 | St. Lawrence | 190/111 |
| 2,732,581 | 1/1956 | Heck | 220/338 |
| 2,797,840 | 7/1957 | Gibbs | 220/338 |
| 2,990,082 | 6/1961 | Boysen | 220/338 |
| 3,059,681 | 10/1962 | Lorbeski | 206/315.4 X |
| 3,460,597 | 8/1969 | Daly | 206/315.4 |
| 4,498,579 | 2/1985 | Brick | 206/315.4 |
| 4,767,001 | 8/1988 | Kim | 206/315.4 X |
| 4,905,827 | 3/1990 | Kim | 206/315.4 X |
| 4,911,292 | 3/1990 | Airey, Jr. | 206/315.4 X |

FOREIGN PATENT DOCUMENTS

| | | | |
|---|---|---|---|
| 2255296 | 5/1974 | Fed. Rep. of Germany | 150/165 |

OTHER PUBLICATIONS

Sharper Image Catalog (1989), p. 11.

*Primary Examiner*—Sue A. Weaver

*Attorney, Agent, or Firm*—St. Onge Steward Johnston & Reens

[57] ABSTRACT

A hinge mechanism for a cover of a container such as a golf bag comprises a spine, and at least one door panel. The spine has a slot which extends vertically from its lower edge. A pin extends transversely across the slot. A radially outwardly extending rib is formed on the container and fits into the slot in the spine. The rib has a channel therein to receive and trap the pin. The cover is movable about the pin from an upright closed position to an inverted open position in which the cover is adjacent the container and usable as a receptacle.

15 Claims, 5 Drawing Sheets

HINGED COVER FOR A GOLF BAG CONTAINER

FIELD OF THE INVENTION

The present invention relates to a hinge mechanism for a cover for a container such as a blow molded golf bag that permits the use of the cover as a convenient receptacle.

BACKGROUND OF THE INVENTION

Lightweight travel golf bags are known and used by golfers desiring to bring their golfing equipment with them while travelling or on vacation. Such golf bags have generally been manufactured of nylon fabrics. The disadvantage of such nylon golf bags is that they do not provide the protection of a more rigid bag. Rigid plastic golf bags have been proposed but have not been popularly received. Prior art plastic golf bags have had cumbersome designs for connecting the cover to the bag. In such designs, the cover, once opened, must be separately carried or otherwise stored. Unlike nylon golf bags or conventional leather golf bags, the hard plastic cover cannot be folded and stored within pockets in the bag. It is to be appreciated that the golfer who is already carrying his bag will find it extremely awkward to carry the cover as well.

It would be desirable to provide a golf bag cover in a plastic golf bag that is easily opened and which may be retained with the bag. It would be desirable if the cover could be used as a receptacle for towels, golf balls, gloves and the like.

SUMMARY OF THE INVENTION

It is an object of the present invention to provide a container cover that allows the cover to be used as a receptacle once it is removed to provide access to the container contents. It is an object of the invention to provide a hinged container cover that allows the cover to be opened and moved to a convenient inverted position adjacent the container without removing the cover from the container. It is a particular object of the invention to provide a hinged cover for a plastic golf bag.

In accordance with the invention, a container cover comprises a spine, and at least one door panel which is hinged to and latchable together with the spine. The spine has a slot which extends vertically from its lower edge. A pin extends transversely across the slot. A radially outwardly extending rib is formed on the container and fits into the slot in the spine. The rib has a channel therein to receive and trap the pin. The channel preferably extends inwardly and curves downwardly from the rearward edge of the rib.

The cover is movable from an upright closed position to an inverted open position in which the cover is usable as a receptacle. The cover is moved from the upright position to the inverted position by opening the cover sufficiently for it to be free of a retaining mechanism and rotating it about the pin to an inverted position. The cover is then closed and latched together and is useful as a receptacle.

Other objects, aspects and features of the present invention in addition to those mentioned above will be pointed out in or will be understood from the following detailed description provided in conjunction with the accompanying drawings.

DETAILED DESCRIPTION OF THE PREFERRED EMBODIMENT

Figure 1:
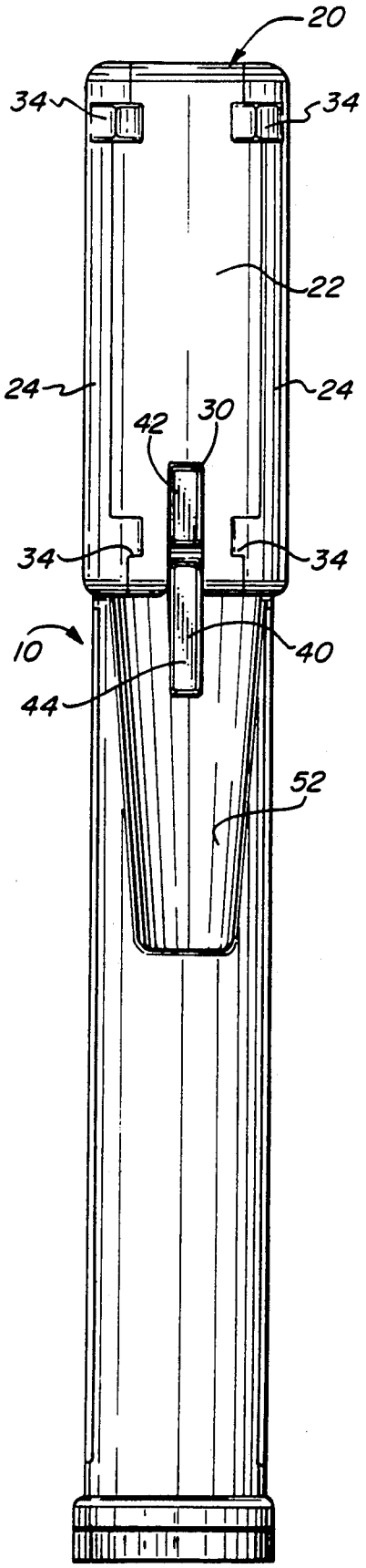
FIG. 1 is a rear elevational view of a hinge mechanism for a container cover in accordance with the invention in a golf bag.

Referring now to FIGS. 1–2 and 6–7 a container, shown as a golf bag 10, has a cover 20. Cover 20 comprises a spine 22 and at least one door panel 24. As shown in the Figures, there are preferably two such door panels 24 which flank the spine 22. Cover 20 is enclosed except for its open end 26 which seats on the upper end of the bag 10.

Spine 22 has a slot 30 which extends vertically upwardly from the rear lower edge of spine 22. Slot 30 is preferably a straight slot. Pin 32 extends transversely across the lower edge of slot 30. Pin 32 is preferably a tubular pin and is either integrally formed with spine 22 or is securely affixed thereto.

Figure 3:
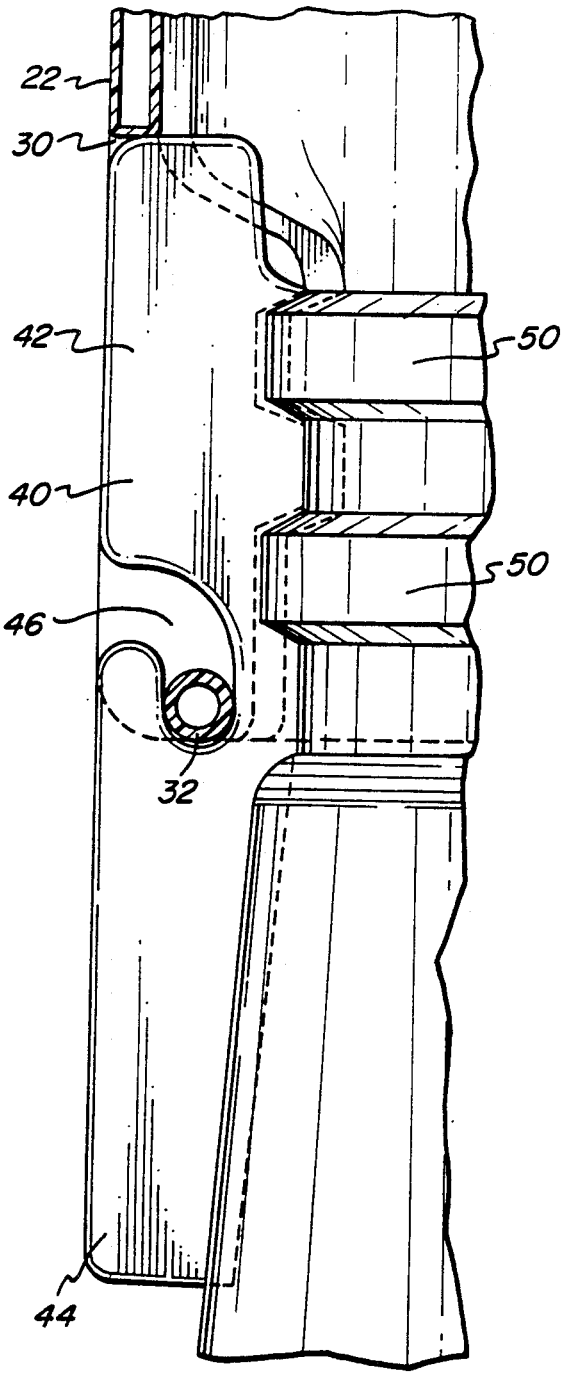
FIG. 3 is a detail cutaway right side view of the hinge mechanism for the cover of FIG. 2.
Figure 4:
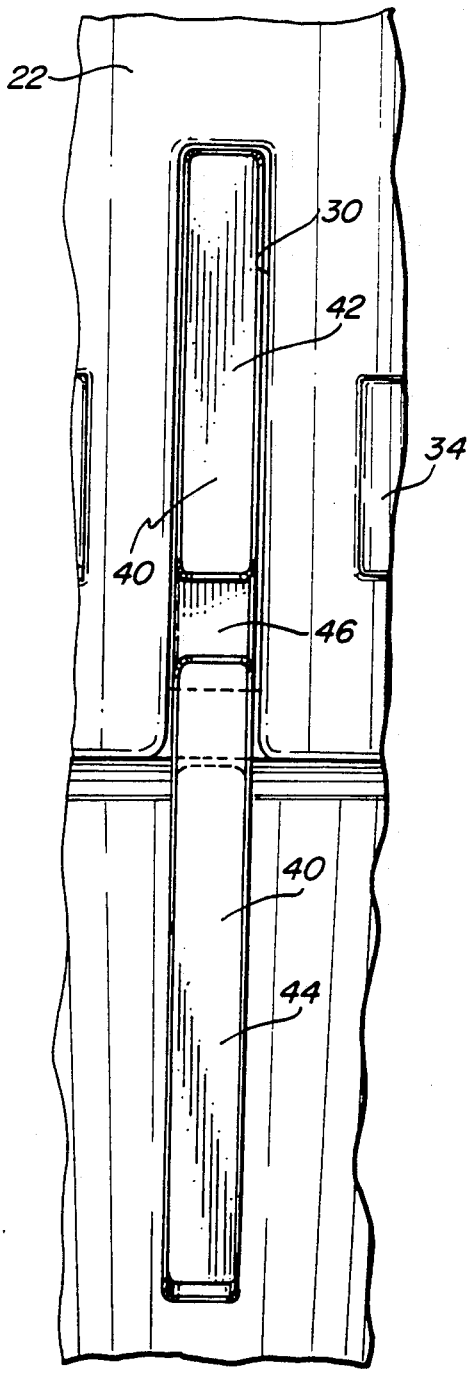
FIG. 4 is a rear detail view of the hinge mechanism of FIG. 1.
Figure 5:
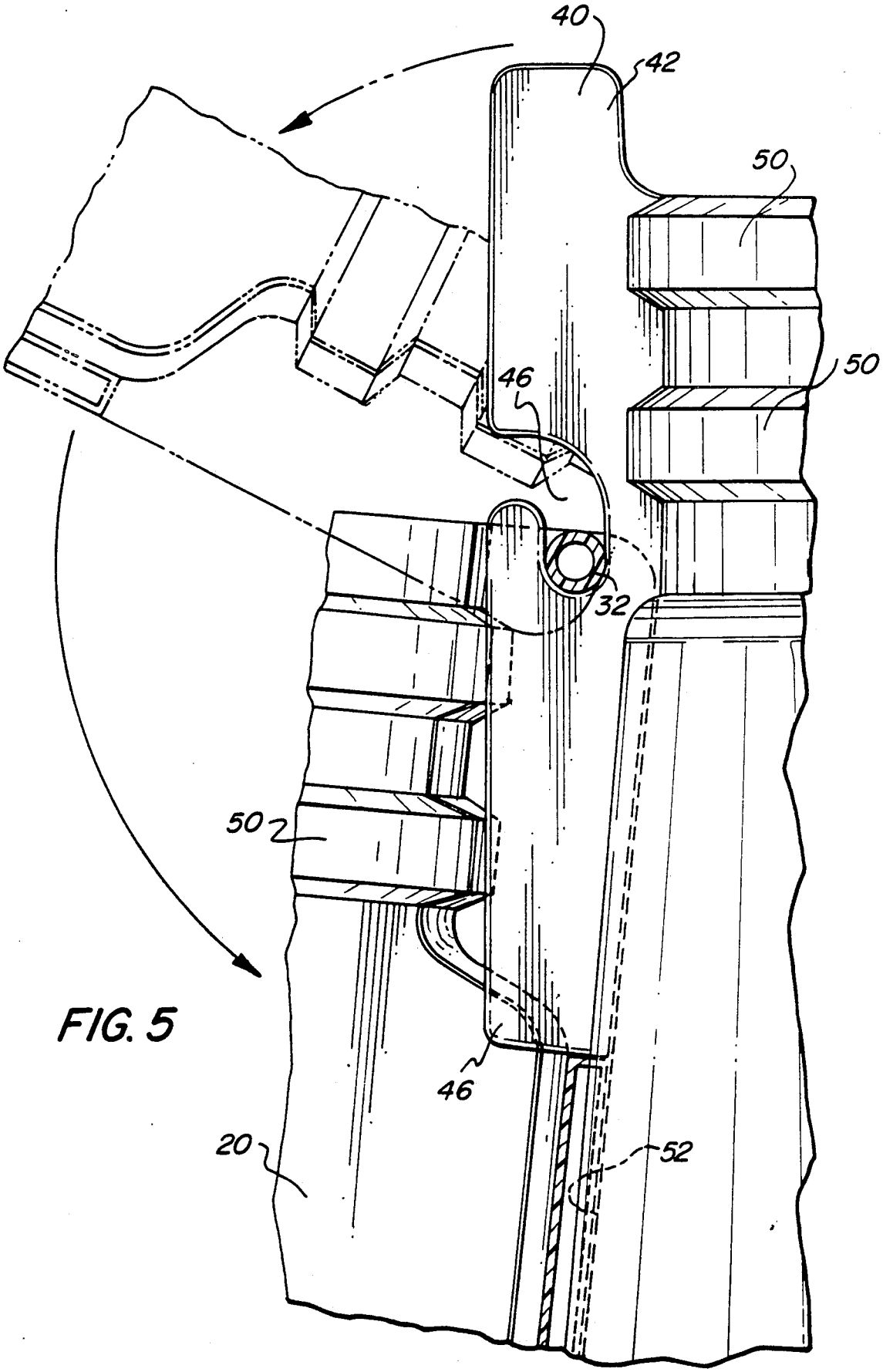
FIG. 5 is a detail right side view of the hinge mechanism of FIG. 3 showing a cover movable from an upright position to an inverted position for use as a receptacle.

A radially outwardly extending rib 40 is formed on the container 10 and is sized to fit into the slot 30 in the spine 22. In particular, rib 40 has a width that fits slot 30. As can be seen in FIGS. 3–5, rib 40 has an upper rib 42 and a lower rib 44. The rib 40 has a channel 46 therein to receive and trap the pin 32. The channel 46 preferably extends inwardly and curves downwardly from the rearward edge of the rib 40. Channel 46 separates the upper and lower ribs 42 and 44. The length of upper rib 42 is less than the length of slot 30 so that rib 42 fits neatly in the slot 30 when the cover 20 is in its upright position. The length of lower rib 44 is also less than the length of slot 30 so that lower rib 44 fits neatly in the slot 30 when the cover 20 is in its inverted position. The rib 40 has a depth such that the rear outer surface of rib 40 is flush with the rear outer surface of spine 22 when cover 20 is in the upright position.

Hinges 34 connect the spine 22 to the door panels 24. Preferably there are two such hinges for each connection of a door panel 24 to the spine 22. Each hinge may be a simple hinge pin formed integrally with the spine 22 which seats in a hinge hole formed in the door panels 24.

Releasable latches 36 are attached to the door panels 24 to latch them together and keep the cover closed as desired.

Figure 6:
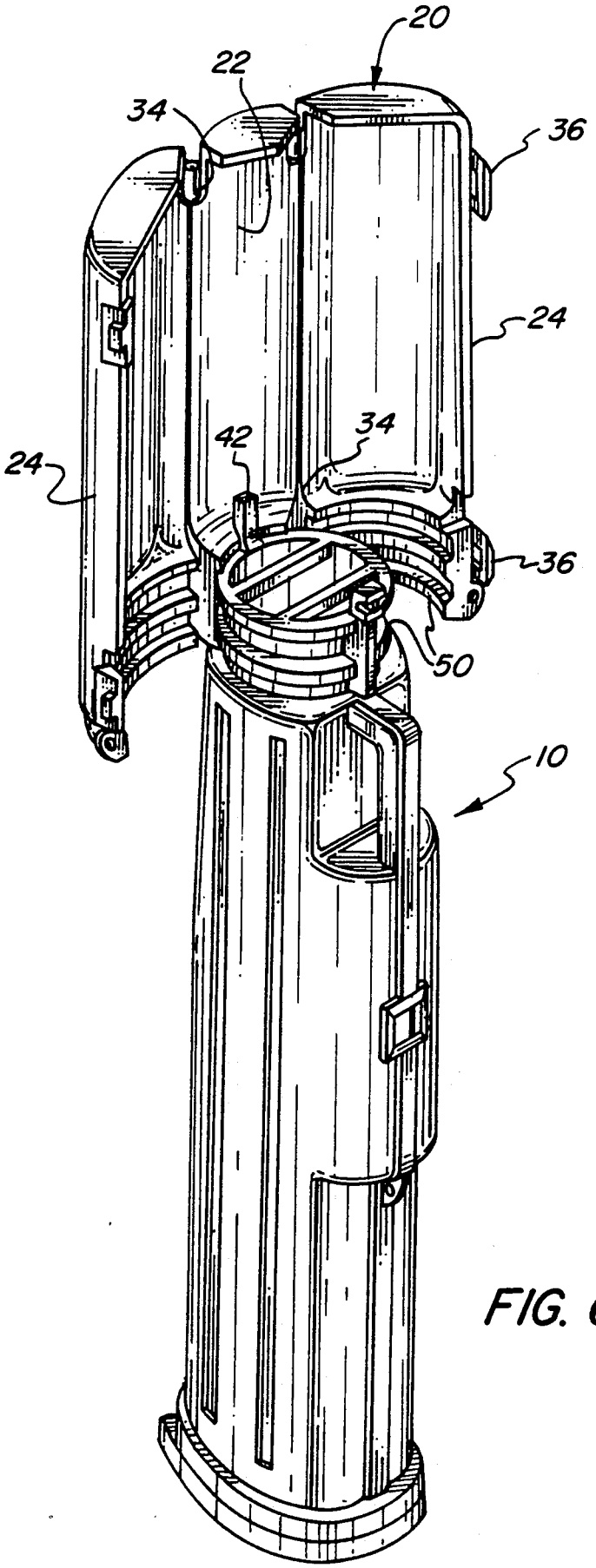
FIG. 6 is a perspective view of a golf bag having a hinge mechanism of the invention with the cover in an open, upright position.

Means for retaining the cover 20 to the container 10 when said cover 20 is in an upright closed position are provided. Preferably, the retaining means comprise a pluralitY of interfitting rib segments 50 formed on the container 10 and on the cover 20. As shown in FIG. 6, preferably there are three such rib segments formed inside the cover 20 and two such rib segments formed on the outer upper end of the bag 10.

Figure 2:
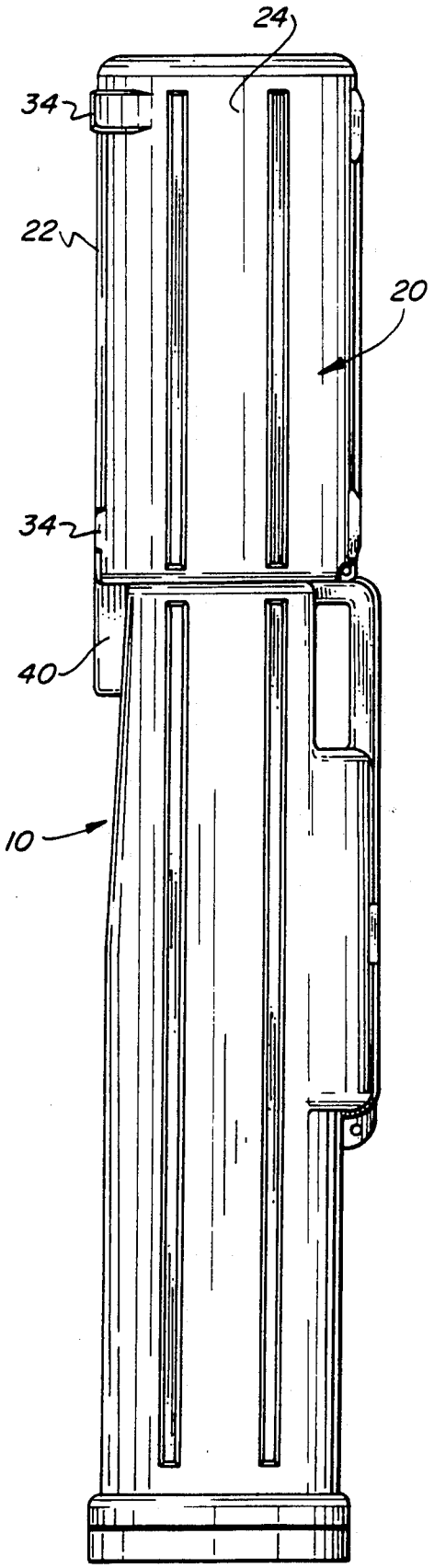
FIG. 2 is a right elevational view of the hinge mechanism for the cover and golf bag of FIG. 1.
Figure 7:
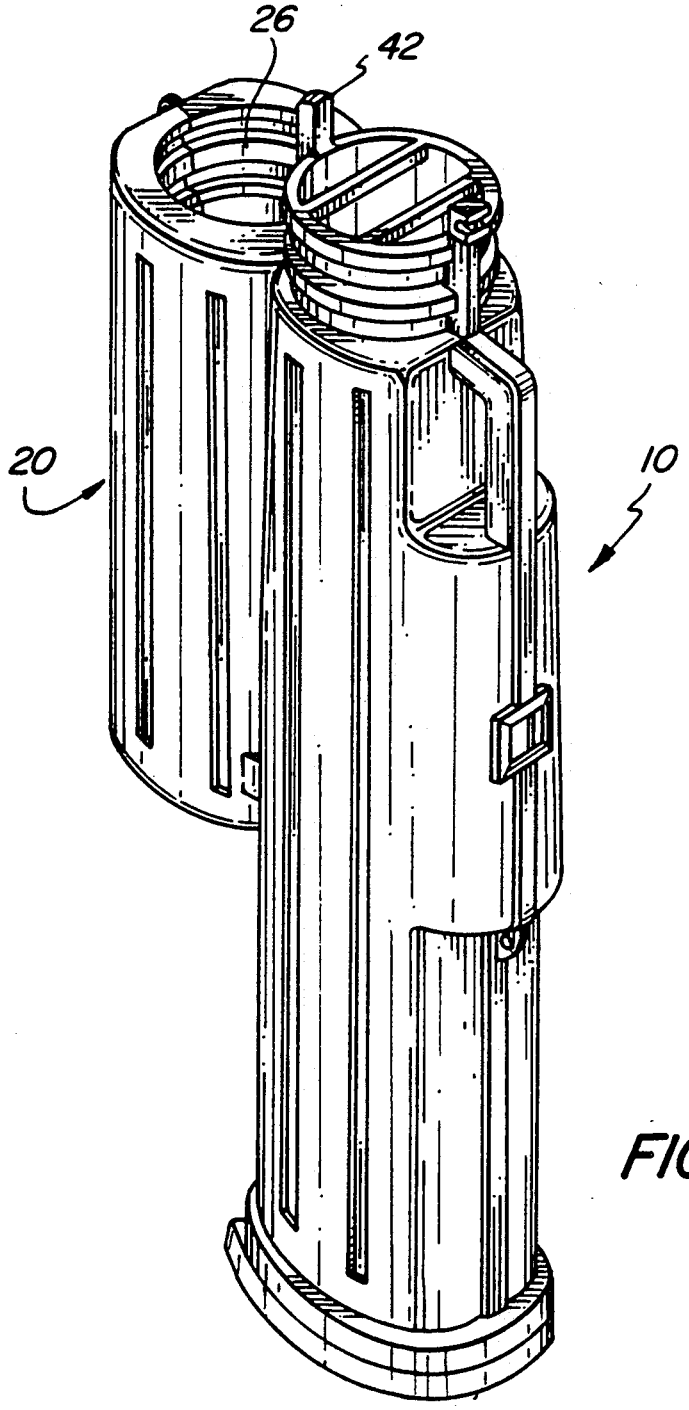
FIG. 7 is a perspective view of the golf bag of FIG. 6 with its cover moved into an inverted closed position for use as a receptacle.

The cover 20 is movable from an upright closed position as shown in FIGS. 1–2 to an inverted open position in which the cover 20 is usable as a receptacle as shown in FIG. 7. The cover is moved from the upright position to the inverted position by releasing the latches 36 and opening the cover 20 to an open upright position as shown in FIG. 6. As shown in FIG. 5, the cover 20 is rotated about the pin 32 to an inverted position. The cover 20 is then closed and latched together and may be used as a receptacle.

Latching hold-down means are preferably provided to hold the cover 20 in its inverted position. Such hold-down means may comprise a ridge on either of the cover or container engageable by a clip on the other of the cover or container.

In a preferred embodiment, the container has a concave zone 52 for receiving the spine 22 when the cover 20 is in its inverted position. The concave zone allows the cover 20 to sit squarely in the inverted position with its opening facing upwardly.

Preferably, the various components of the hinge mechanism, cover and container are manufactured from blow molded plastic. A sufficient weight and wall thickness may be determined to provide the required rigidity and structural strength.

The present invention provides a new hinge mechanism that provides a cover in a plastic golf bag that is readily opened and which is retained with the bag for use as a receptacle for towels, golf balls, gloves and the like.

I claim:

1. A cover and hinge mechanism for a container, comprising:

a spine having a lower edge and lateral sides;

a slot formed in said spine and extending vertically from said lower edge of said spine;

a pin extending transversely across said slot at said lower edge of said spine;

two door panels each having two lateral sides, one lateral side of each being hingingly affixed to said lateral sides of said spine, said spine and door panels together defining said container cover;

hinging means for connecting said lateral sides of said spine to lateral sides of said door panels and to said spine, whereby unhinged lateral sides of said door panels may be moved apart or together to respectively open and close said cover;

releasable latching means for latching said door panels together to hold said cover in a closed position;

a radially outwardly extending rib formed in an upper end of the container, said rib having an upper rib section and a lower rib section separated by a channel, said channel being sized and adapted to receive and trap said pin, said spine being movable from an upright position to an inverted position about said pin, said upper rib section being sized and adapted to fit into said spine slot when the spine is in an upright position, said lower rib section being sized and adapted to fit into said spine slot when said spine is in an inverted position.

2. A cover and hinge mechanism for a container in accordance with claim 1, further comprising means for retaining said spine and door panel to said container when said cover is in an upright closed position.

3. A cover and hinge mechanism for a container in accordance with claim 2, wherein said means for retaining said spine and door panels to said container comprise a plurality of interfitting rib segments formed on said container and on said cover.

4. A cover and hinge mechanism for a container in accordance with claim 1, wherein said channel in said rib extends inwardly from a rearward edge of said rib and curbes downwardly.

5. A cover and hinge mechanism for a container in accordance with claim 1, further comprising a concave zone formed in the rear of said container for receiving said spine when said cover is in its inverted position.

6. A cover and hinge mechanism for a container in accordance with claim 1 wherein said container and cover comprise a golf bag formed from a polymeric material.

7. A cover and hinge mechanism for a container, comprising:

a rigid spine having a lower edge;

a slot formed in said spine and extending vertically from said lower edge of said spine;

a pin extending transversely across said slot at said lower edge of said spine;

a radially outwardly extending rib formed in an upper end of the container, said rib having an upper rib section and a lower rib section separated by a channel extending inwardly and curving downwardly, said channel being sized and adapted to receive and trap said pin, said spine being movable from an upright position to an inverted position about said pin, said upper rib section being sized and adapted to fit into said spine slot when spine is in an upright position, said lower rib section being sized and adapted to fit into said spine slot when said spine is in an inverted position;

two rigid door panels located adjacent lateral sides of said spine, said spine and door panels together defining said container cover;

hinging means for connecting said spine and said door panels and permitting relative movement of said door panels relative to said spine to open and close said cover;

releasable latching means attached to said door panels to latch said door panels together and hold said cover in a closed position;

means for retaining said spine and door panel to said container when said cover is in an upright closed position;

said cover being movable from an upright closed position to an inverted open position with said cover usable as a receptacle by releasing said latching means, opening said spine and door panel, rotating said spine and door panel about said pin to an inverted position, and closing and latching together said spine and door panel.

8. A cover and mechanism for a container in accordance with claim 7, wherein said means for retaining said spine and door panels to said container comprise a plurality of interfitting rib segments formed on said container and on said cover.

9. A cover and hinge mechanism for a container in accordance with claim 7, further comprising a concave zone formed in the rear of said container for receiving said spine when said cover is in its inverted position.

10. A cover and hinge mechanism for a container in accordance with claim 7 wherein said container and cover comprise a golf bag formed from a polymeric material.

11. A golf bag, comprising:

a blow molded polymeric golf club container;

a blow molded closable polymeric cover for said container having a spine which is pivotally affixed to said container by pivoting means permitting pivoting movement of said spine from an upright position to an inverted position, at least one door panel which is affixed to one lateral side of said spine by hinging means permitting lateral movement of said door panel relative to said spine whereby said door panel and spine are pivotable together from an upright position to an inverted position and whereby unhinged lateral sides of said door panels may be moved apart or together to respectively open and close said cover, and releasable latching means attached to said door panel to hold said door panel and spine in a fixed relationship and thereby hold said cover in a closed position; and means for retaining said spine and door panel to said container when said cover is in an upright closed position;

said cover being movable from an upright closed position to an inverted position with said cover usable as a receptacle by releasing said latching means, opening said spine and door panel, rotating said spine and door panel to an inverted position, and closing and latching together said spine and door panel.

12. A golf bag in accordance with claim 11, wherein said pivoting means comprise:

a slot formed in said spine and extending vertically from a lower edge of said spine;

a pin extending transversely across said slot at said lower edge of said spine;

a radially outwardly extending rib formed in an upper end of the container, said rib having an upper rib section and a lower rib section separated by a channel extending inwardly and curving downwardly, said channel being sized and adapted to receive and trap said pin, said spine being movable from an upright position to an inverted position about said pin, said upper rib section being sized and adapted to fit into said spine slot when spine is in an upright position, said lower rib section being sized and adapted to fit into said spine slot when said spine is in an inverted position.

13. A golf bag in accordance with claim 12, wherein there are two said door panels located adjacent lateral sides of said spine, said spine and door panels together defining said enclosed cover.

14. A golf bag in accordance with claim 13, wherein said means for retaining said spine and door panel to said container comprise a plurality of interfitting rib segments formed on said container and on said cover.

15. A golf bag in accordance with claim 11, further comprising a concave zone formed in the rear of said container for receiving said spine when said cover is in its inverted position.

* * * * *